United States Patent [19]

Hoszowski

[11] Patent Number: 4,722,419

[45] Date of Patent: Feb. 2, 1988

[54] SWIM PLATFORM

[75] Inventor: Andrew K. Hoszowski, Greenville, Miss.

[73] Assignee: Moeller Manufacturing Co., Inc., Greenville, Miss.

[21] Appl. No.: 882,627

[22] Filed: Jul. 7, 1986

[51] Int. Cl.[4] ..... B63B 27/14

[52] U.S. Cl. ..... 182/91; 182/86; 114/362; 280/166

[58] Field of Search ..... 182/91, 92, 97, 106, 182/86, 33.6, 33.5; 114/362, 343; 280/166

[56] References Cited

U.S. PATENT DOCUMENTS

| | | | |
|---|---|---|---|
| 2,577,438 | 12/1951 | Sussman | 182/33.6 |
| 3,195,680 | 7/1965 | Thornburg | 182/92 |
| 3,716,254 | 2/1973 | Tarvin | 280/166 |
| 3,794,140 | 2/1974 | Sell | 182/92 |
| 4,198,070 | 4/1980 | Weiler | 280/166 |
| 4,462,485 | 7/1984 | Terry | 182/91 |
| 4,541,507 | 9/1985 | Gibellato | 182/86 |
| 4,611,552 | 9/1986 | Koppelomaki | 182/92 |

*Primary Examiner*—Reinaldo P. Machado

*Attorney, Agent, or Firm*—Berman, Aisenberg & Platt

[57] ABSTRACT

A swim platform is described in which two S-shaped members spanned by a step are pivotally attached beneath a platform which is attached to the transom of a boat. The step hangs outboard of an outboard edge of the platform in use, or may be folded to rest on the platform when not being used.

6 Claims, 4 Drawing Figures

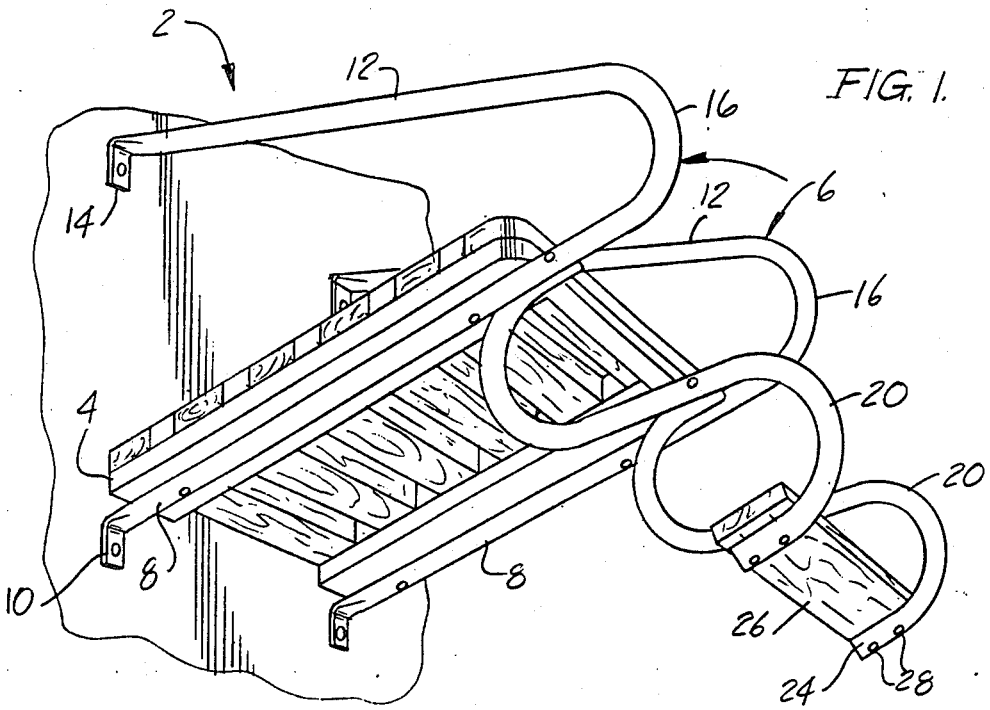
FIG. 1.
FIG. 2.
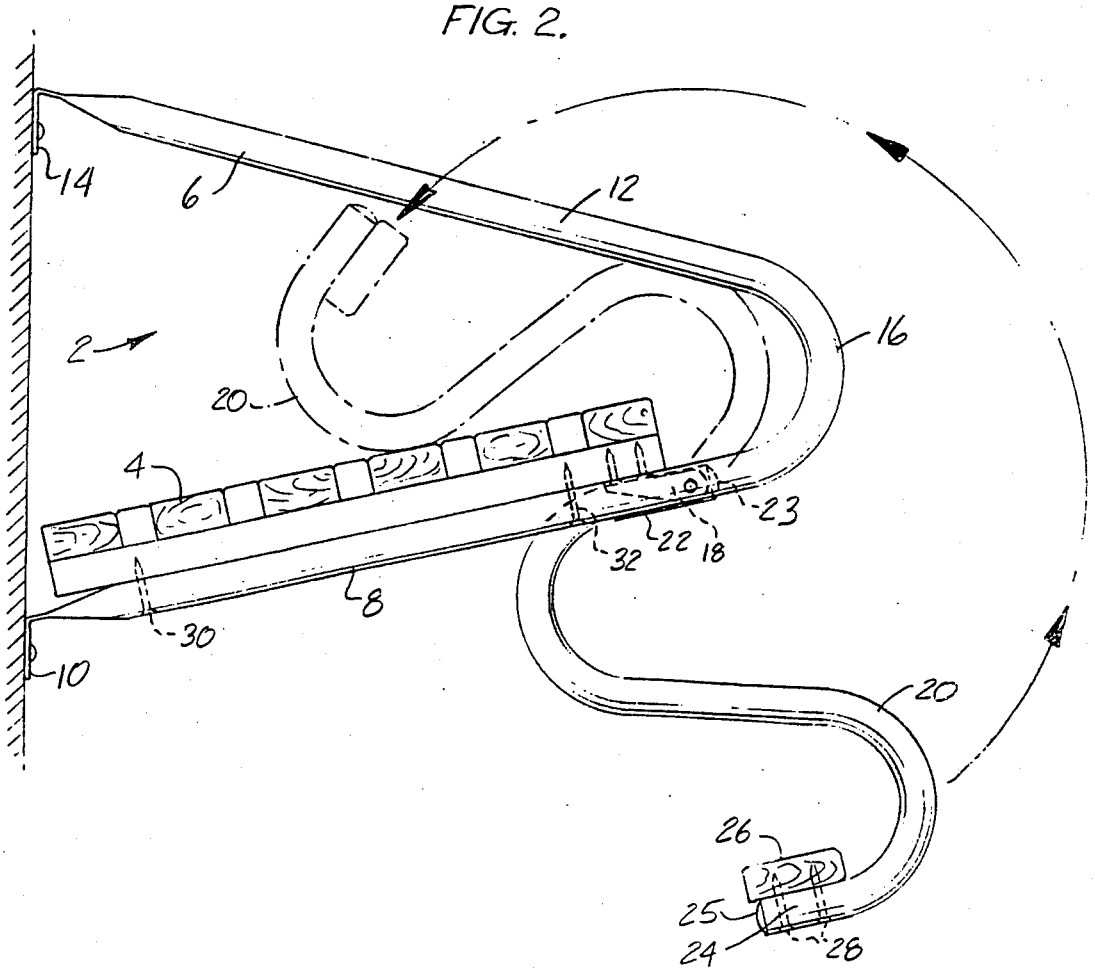

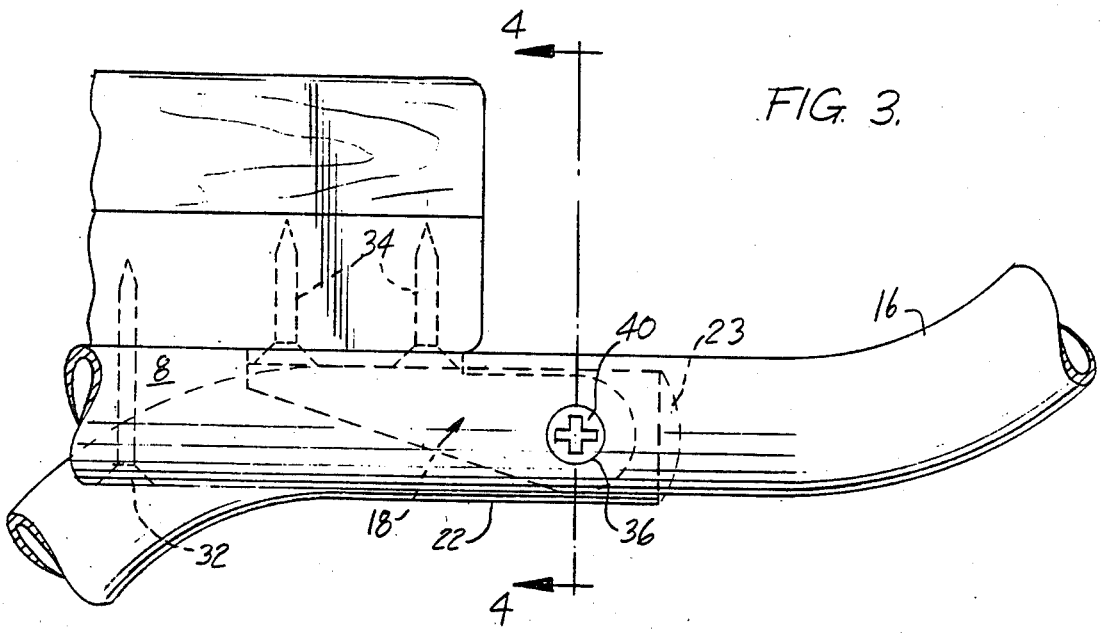
FIG. 3.
FIG. 4.
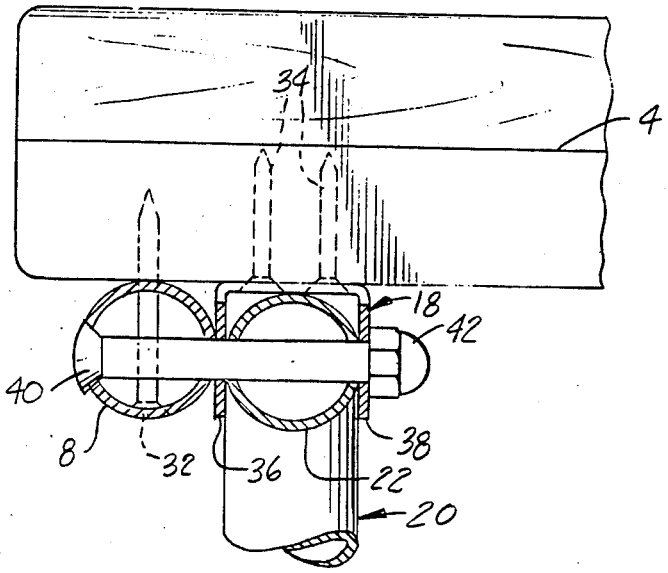

SWIM PLATFORM

FIELD OF THE INVENTION

This invention relates to ladders or platforms with attached ladders for attaching to the transom of a boat for use in entering the water from the boat or entering the boat from the water.

DESCRIPTION OF THE PRIOR ART

Prior art combinations of platforms with pivoted ladders for attaching to the transom of a boat have suffered from a number of disadvantages. U.S. Pat. Nos. 4,462,485 and 3,794,140 disclose platforms with pivoted ladders which fold when not in use. Each of these patents shows a structure which lacks the inherent strength of the swim platform of the present invention.

OBJECT OF THE INVENTION

A principal object of the invention is to provide a new improvement in boat ladders of the combination platform-step type. A further object is to provide a platform having S-shaped members supporting the step. Another object of the invention is to provide brackets underneath the platform, from which the S-shaped supports for the step are pivoted.

SUMMARY OF THE INVENTION

These objects are accomplished according to the present invention by the provision of a swim platform for attachment to the transom of a boat having two spaced apart brackets attached underneath an outboard edge of the platform and an S-shaped member attached to each of the brackets. A step spans the lower ends of the two S-shaped members. The step may be lowered, and in its lowered position the step hangs outboard of the outboard edge of the platform. In its raised position, the step rests inboard of the outboard edge of the platform. The platform may be supported, for example, by two tubular, substantially U-shaped, members attached to the boat, each tubular member supporting a side of the platform. The brackets which form part of the pivotal attachment of the members supporting the step are placed underneath the platform adjacent to the tubular members supporting the platform so that a pivot pin may extend sequentially through a lug of the bracket, an upper end of one of the S-shaped members supporting the step, a second lug of the bracket and the tubular member adjacent the bracket, supporting the platform.

BRIEF DESCRIPTION OF THE DRAWING

FIG. 1 is a front perspective view of the swim platform.

FIG. 2 is a side elevation view of the swim platform.

FIG. 3 is a side elevation view of the bracket structure shown in FIG. 2.

FIG. 4 is a front sectional view of the bracket structure taken on line 4—4 of FIG. 3.

DETAILED DESCRIPTION OF THE INVENTION

Referring now to the figures in which like parts are identified by similar numbers, FIGS. 1 and 2 show swim platform 2 of the invention in which platform 4 is supported on substantially U-shaped members 6. Members 6 are typically metal tubular members, and have a lower supporting section 8 which ends in a fixture 10 suitable for attachment to the transom of a boat, and an upper section 12 terminating in end fixture 14, suitable for attaching to the transom of a boat. Lower section 8 and upper section 12 are connected by curved section 16. Platform 4 may appropriately be prefabricated of suitable material, for example, wood, metal or plastic, and fastened to lower supporting section 8 by screws 30 and 32, for example, or any other appropriate form of affixation may be used. Platform 4 may alternatively be made of individual strips of planking of suitable material, such as wood, metal or plastic, affixed independently to lower supporting section 8.

Attached to the underside of platform 4 are two brackets 18. S-shaped member 20 is attached at its top end 22 to bracket 18. The S-shaped members are made of suitable material, for example, tubular metal. The ends of the S-shaped members may have optional plugs or caps 23, 25.

Step 26 spans lower ends 24 of the S-shaped members. Step 26 which may be made of wood, metal, plastic or other appropriate material, is attached to lower end 24 of the S-shaped members by, for example, screws 28. Other appropriate fastening means may be used.

Referring now to FIGS. 3 and 4 which show the bracket 18 and surrounding structure in detail, bracket 18 is fastened to the underside of platform 4, for example, by screws 34. Bracket 18 has lugs 36, 38 depending downward from its base which is screwed to the platform. Bracket 18 holds top end 22 of S-shaped member 20 in pivotal attachment; pivot pin 40 extends sequentially through supporting section 8, lug 36, end 22 of S-shaped member 20, and lug 38, and is secured at its other end by, for example, nut 42.

In use, the two S-shaped members 20 depend downward from the brackets 18 and step 26 hangs outboard of outboard end of platform 4. As the step hangs outboard of the outboard end of the platform, it is more convenient, and safer, to use than if the step hangs under the outboard end of the platform. When the step is not in use, the S-shaped members 20, which are spanned by step 26, may be folded up to rest on platform 4 as shown by the dotted lines in FIG. 2. In the folded position, the step 26 and S-shaped members 20 rest between members 6. Each U-shaped member 6 is shown in the figures to have its ends 10 and 14 adapted for direct attachment to the transom of the boat. Other means of attachment may be used, for example, brackets may be attached to the transom of the boat with pivotal attachments for member 6.

As shown in the figures, upper section 12 of U-shaped member 6 may be used conveniently as a handhold. However, this is not a necessary feature of the invention and the U-shaped members may be inverted to be attached to the boat below the platform instead of above the platform. Alternative means of support for the platform may also be used.

A particular advantage of the invention is that when the user places a foot on the step an upward force is established at bracket 18, to which top end 22 of S-shaped member 20 is secured, providing enhanced strength and stability for the swim platform. The swim platform of the invention which uses these S-shaped members is simple and inexpensive to construct, and is strong and safe in use. Particular advantages derived from the S-shaped members also include strength derived inherently from the S-shape of the step-supportive members, and in addition, the step is easy to climb on from the water since the lower part of the S-members, adjacent to the step form easily grasped handholds for the user. The step is also safe when folded into a stable position resting on the platform, the smooth, curved tubular sections having no exposed sharp edges.

Variations and modifications may be effected within the scope of the invention as described above, and as defined in the appended claims.

What is claimed is:

1. A swim platform for attachment to a transom of a boat comprising:

two spaced-apart brackets attached underneath an outboard edge of the platform, a first S-shaped member having a first end pivotally attached to the first bracket, a second S-shaped member having a first end pivotally attached to the second bracket, and a step spanning second ends of the two S-shaped members, wherein, in a lowered position, the step hangs outboard of said outboard edge of the platform, and, in a raised position, the step rests inboard of said outboard edge of the platform.

2. A swim platform of claim 1 further comprising two spaced-apart members attached underneath the platform, each of said spaced-apart members having at least one end attached to the transom of the boat.

3. A swim platform of claim 2 wherein each bracket is adjacent to one of the spaced-apart members on the side of said member toward the other bracket.

4. A swim platform of claim 3 wherein each pivotal attachment comprises a pivot pin extending sequentially through a first lug of the bracket, the first end of the S-shaped member, a second lug of the bracket, and the member adjacent the bracket.

5. A swim platform of claim 1 wherein said S-shaped members are tubular.

6. A swim platform for attachment to a transom of a boat comprising:

two spaced-apart brackets attached underneath an outboard edge of the platform, a first S-shaped member having a first end pivotally attached to the first bracket, a second S-shaped member having a first end pivotally attached to the second bracket, and a step spanning second ends of the two S-shaped members, and means for causing an upward force underneath the platform when pressure is applied downward on the step, wherein, in a lowered position, the step hangs outboard of said outboard edge of the platform, and, in a raised position, the step rests inboard of said outboard edge of the platform.

* * * * *